US007818909B2

(12) United States Patent
Hori et al.

(10) Patent No.: US 7,818,909 B2
(45) Date of Patent: Oct. 26, 2010

(54) IMAGE RECORDING MEDIUM

(75) Inventors: Kazuhito Hori, Nagano (JP); Hiroshi Asawa, Nagano (JP); Keiichi Oshima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1721 days.

(21) Appl. No.: 10/929,112

(22) Filed: Aug. 27, 2004

(65) Prior Publication Data

US 2005/0091898 A1 May 5, 2005

(30) Foreign Application Priority Data

Aug. 29, 2003 (JP) ..... P2003-308133

(51) Int. Cl.
*A47G 1/06* (2006.01)

(52) U.S. Cl. ..... 40/753; 40/124.17

(58) Field of Classification Search ..... 40/124.17, 40/750, 751, 753–755; 248/459, 460, 463
See application file for complete search history.

(56) References Cited

U.S. PATENT DOCUMENTS

| | | | | |
|---|---|---|---|---|
| 4,509,712 | A * | 4/1985 | Moller | 248/464 |
| 4,947,566 | A * | 8/1990 | Hoebel | 40/773 |
| 5,351,425 | A * | 10/1994 | Knappe et al. | 40/751 |
| 5,428,423 | A * | 6/1995 | Clark | 355/77 |
| 5,517,776 | A * | 5/1996 | Knappe et al. | 40/753 |
| 5,855,396 | A * | 1/1999 | Simpson-Jones et al. | 283/112 |
| 2005/0193604 | A1 * | 9/2005 | Fein | 40/124.17 |

FOREIGN PATENT DOCUMENTS

| | | |
|---|---|---|
| JP | 44718 | 1/1918 |
| JP | 52-13791 | 7/1975 |
| JP | 55-89666 | 12/1978 |
| JP | 7-1873 | 6/1995 |
| JP | 3014055 | 8/1995 |
| JP | 7-299972 | 11/1995 |
| JP | 8-282746 | 10/1996 |
| JP | 10-129159 | 5/1998 |
| JP | 3052703 | 7/1998 |
| JP | 2000-312635 | 11/2000 |
| JP | 2002-160420 | 6/2002 |
| JP | 2003-039774 | 2/2003 |
| JP | 2003-266973 | 9/2003 |

OTHER PUBLICATIONS

English translation of JP 52-13791 dated Jul. 16, 1975.
Patent Abstracts of JP 7-29972 dated Nov. 14, 1995.
JPO Computer English Translation of JP 3052703 dated Jul. 15, 1998.
Patent Abstracts of JP 8-282746 dated Oct. 29, 1996.
Patent Abstracts of JP 10-129159 dated May 19, 1998.
English translation of JP 44718 dated Jan. 16, 1918.
English translation of Japan 55-89666 dated Dec. 12, 1978.
Patent Abstracts of Japan 7-1873 dated Jun. 1, 1995.

* cited by examiner

*Primary Examiner*—Cassandra Davis
(74) *Attorney, Agent, or Firm*—Ladas & Parry LLP

(57) ABSTRACT

An image recording medium includes a base member having an image recording face on which an image is recorded, and a holding member which is operable to hold the base member at an angle of predetermined degree with respect to an installation face for the base member.

8 Claims, 10 Drawing Sheets

IMAGE RECORDING MEDIUM

BACKGROUND OF THE INVENTION

The present invention relates to an image recording medium which can be used as a photo stand, for example, after an image has been recorded thereon.

As a digital camera and a printer of high image quality have become popular, it has become possible to make photographic prints easily, even at home. For example, by employing an inkjet printer and inkjet recording paper for the purpose, it is possible to make photographic prints having the image quality as high as a photograph by a silver salt film. Generally, such a photographic print has been recorded on an image recording medium such as the recording paper of high image quality exclusively for the purpose. However, because the image recording medium and the photo stand have been separate members, in case where the image recording medium having the image printed thereon is displayed on a table or the like, it has been necessary to set the image recording medium on the photo stand which has been separately prepared.

As an example of the recent photo stands of a handy type, there is a photo stand including two panels formed of cardboard or the like and adhered to each other, in which a leg portion of a pull-up type is provided on a back face of the panels. By pulling up this leg portion, the panels can be made upright at an angle of appropriate degree (Reference should be made to JP-UM-B-3014055). In case of using the photo stand of this type, the photographic picture which has been printed in advance is inserted between the two panels, and the panels are made upright by the leg portion so that the photograph can be seen through an opening on the front face.

By the way, although it has become possible to easily print the photograph, as the digital camera and the printer of the high image quality have become popular, as described above, considering a step of displaying the printed photograph, it has been troublesome that the printed photograph must be set on the photo stand which has been separately prepared. Under the circumstances, from a viewpoint of easy handling, further improvements have been required.

SUMMARY OF THE INVENTION

The invention has been made in view of the above described circumstances, and an object of the invention is to provide an image recording medium which enables a recorded image to be displayed, for appreciation, more easily on a table or the like.

In order to attain the above described object, an image recording medium according to the invention comprising:

a base member having an image recording face to be recorded an image thereon, and a holding member being operable to hold the base member at an angle of predetermined degree with respect to an installation face of the base member.

According to the above described structure, the base member can be made upright on the installation face such as a table, immediately after an image has been recorded on the image recording face of the base member, by employing the holding member, and the image recording medium can be used as a photo stand, as it is. Therefore, a trouble of separately preparing the photo stand will be eliminated, and it is possible to easily display printed matters such as a photograph on the table.

Preferably, the base member is provided with the holding member through a connecting portion. The base member is held at the angle of the predetermined degree with respect to the installation face by bending the connecting portion.

According to the above described structure, by bending the connecting portion, the holding member for the base member which is integrally provided on the base member can be set at a position in which the base member can be held at the angle of the predetermined degree. Therefore, the image recording medium can be used as the photo stand easily, without employing a particular tool for the purpose.

Preferably, the holding member includes a leg portion being operable to hold the base member with respect to the installation face by bending the leg portion through the connecting portion, and a leg supporting portion being operable to position the leg portion at an angle of predetermined degree with respect to the base member.

According to the above described structure, the holding member includes the leg portion which is operable to hold the base member by bending the leg portion through the connecting portion, and the leg supporting portion which is operable to position the leg portion at the angle of the predetermined degree with respect to the base member. Therefore, the base member can be held at a certain angle, by anyone who wants to assemble it.

Preferably, the leg supporting portion has a notched groove operable to engage with the leg portion so as to support the base member.

According to the above described structure, because the leg supporting portion is provided with the notched groove, it will be possible to determine positions of the base member and the leg portion relative to each other by the leg supporting portion, and it will be possible to hold the base member stably.

Preferably, the leg supporting portion includes a first notched groove operable to engage with the leg portion so as to support the base member at a first position, and a second notched groove operable to engage with the leg portion so as to support the base member at a second position.

According to the above described structure, because the two notched grooves are provided, the base member can be supported at the two positions, by selecting either of engaging positions between the leg portion and the notched grooves. For example, the leg portion and the leg supporting portion can be co-used in both the cases where the base member is vertically installed and the base member is laterally installed.

Preferably, the holding member is a plurality of the holding members.

According to the above described structure, because there are provided a plurality of the holding members, the base member can be stably supported in various postures, by appropriately selecting the holding members to be used. For example, in both the cases where the base member is vertically installed and laterally installed, different sets of the holding members can be used, and thus, the base member can be supported at a stabilized angle and in a stabilized posture in either of the cases.

Preferably, the base member has a first base portion having the image recording face, and a second base portion (adhesively) superposed on the first base portion. The second base portion is provided with the holding member.

According to the above described structure, the base member includes the first base portion having the image recording face, and the second base portion superposed thereon, and the bolding member is provided on the second base portion. Therefore, such works as forming a cutting portion (a cutting line) for the purpose of providing the holding member can be conducted without influencing the first base portion having the image recording face, and the production will become easy. Moreover, because the base member is composed of the two layers superposed, the works will be conducted easily in case where various functions are shared by the front face (the first base portion) and the back face (the second base portion).

Preferably, the holding member is formed by cutting a part of the second base portion.

According to the above described structure, because the holding member is formed by cutting a part of the second base portion, the holding member can be pulled up along the cutting line thereby to easily set the base member in a position held in an upright posture.

Preferably, the second base portion has an opening adjacent to the holding member.

According to the above described structure, because the opening is formed in the second base portion at a position adjacent to the holding member, the holding member can be easily pulled up while inserting a finger into the opening, and the assembling work in case of using the image recording medium as the photo stand will be conducted easily.

Preferably, the first base portion has an image recording layer having the image recording face, and a first supporting layer supporting the image recording layer. The second base portion has a second supporting layer formed on the first supporting layer, and a curl preventing layer formed on the second supporting layer for preventing a curl of the base member.

According to the above described structure, because the first base portion includes the image recording layer having the image recording face, and the first supporting layer supporting the image recording layer, while the second base portion has the second supporting layer formed on the first supporting layer, and the curl preventing layer formed on the second supporting layer, a curl of the base member due to change in temperature and so on can be prevented. Therefore, it is possible to keep the base member always in a flat state or in a state having a certain curved face.

Preferably, the curl preventing layer is same as the image recording layer in layer structure.

According to the above described structure, because the curl preventing layer has the same layer structure as the image recording layer, the base member has the symmetrical layer structure on both the front face and the back face. Therefore, it is possible to effectively exert a curl preventing function against the temperature change or so.

Preferably, an auxiliary portion is detachably provided at least at one end of the base member in a longitudinal direction thereof. The auxiliary portion is flush with the image recording face.

According to the above described structure, the auxiliary portion which can be detached from the base member is provided at the end thereof in the longitudinal direction, it is possible to substantially extend the longitudinal length of the base member by the auxiliary portion. For example, it is possible to pass the image recording medium through the image recording apparatus in a stabilized manner, and further, it is possible to record the image up to a position at the extreme end of the base member. Moreover, a user can hold the auxiliary portion to handle the base member, thereby enabling the image recording face of the base member to be protected from being soiled.

Preferably, an auxiliary portion is detachably provided at least at one end of the base member in a longitudinal direction thereof. The auxiliary portion is flush with the image recording face. A complete cutting portion is formed between the auxiliary portion and the first base portion, the complete cutting portion extending in a minor axis direction of the base member. A noncontiguous cutting portion is formed between the auxiliary portion and the second base portion, the noncontiguous cutting portion extending in the minor axis direction of the base member. A first length from an end edge of the auxiliary portion in the longitudinal direction to the complete cutting portion is smaller than a second length from the end edges of the auxiliary portion in the longitudinal direction to the noncontiguous cutting portion.

According to the above described structure, because the complete cutting portion is formed between the auxiliary portion and the first base portion, and the noncontiguous cutting portion (a so-called perforated line) is formed between the auxiliary portion and the second base portion, the auxiliary portion can be easily detached from the base member, by tearing it off along the complete cutting portion and the noncontiguous cutting portion. When the auxiliary portion has been torn off along the noncontiguous cutting portion, there will be formed undulations on the cutting face. However, the noncontiguous cutting portion on the back face side (in the second base portion) is positioned more close to a center of the base member in the longitudinal direction than the complete cutting portion on the front face side (in the first base portion), the aforesaid undulation will be hidden behind the first base portion after the auxiliary portion has been detached. On this occasion, the end edge of the first base portion which has been detached at the complete cutting portion will make a clear cutting line by mechanical cutting. Therefore, the end edge of the base member after the auxiliary portion has been detached will show only the clear cutting line as seen from the front side. In other words, an area having unfavorable appearance will be hidden from the front side, and the appearance as seen from the front side will be improved.

Preferably, a most front layer of the image recording face is an ink reception layer which has at least a pigment and a binder.

According to the above described structure, because the most front layer of the image recording face is the ink reception layer containing at least the pigment and the binder, it is possible to provide a clear image on the image recording face without a spread of an ink, by image recording unit such as an inkjet printer or the like in which the ink is used.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 1A to 1C show a general structure of an image recording medium according to an embodiment of the invention, in which FIG. 1A is a plan view as seen from a front side, FIG. 1B is a side view, and FIG. 1C is a plan view as seen from a back side.

FIGS. 5A and 5B show a manner of detaching an auxiliary portion of the image recording medium, in which FIG. 5A is a side view showing the auxiliary portion in a flat state before it is detached, and FIG. 5B is a side view showing on a way of detaching.

FIGS. 13A to 13C show a general structure of an image recording medium in another embodiment according to the invention, in which FIG. 13A is a plan view as seen from the front side, FIG. 13B is a side view, and FIG. 13C is a plan view as seen from the back side.

DETAILED DESCRIPTION OF THE PREFERRED EMBODIMENTS

Figure 1A:
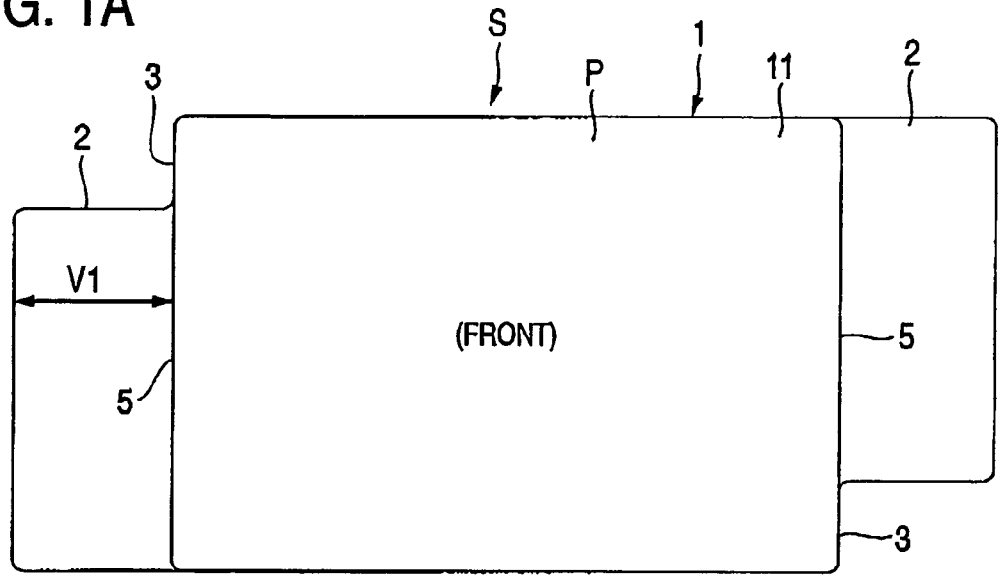

An embodiment of the image recording medium according to the invention in case where it is applied to a photo board which can be also used as a photo stand will be described, referring to the drawings.

Figure 1B:
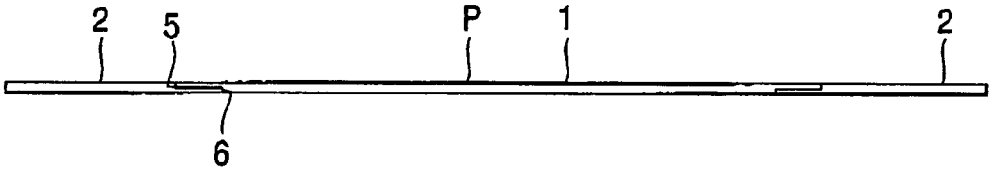
Figure 1C:
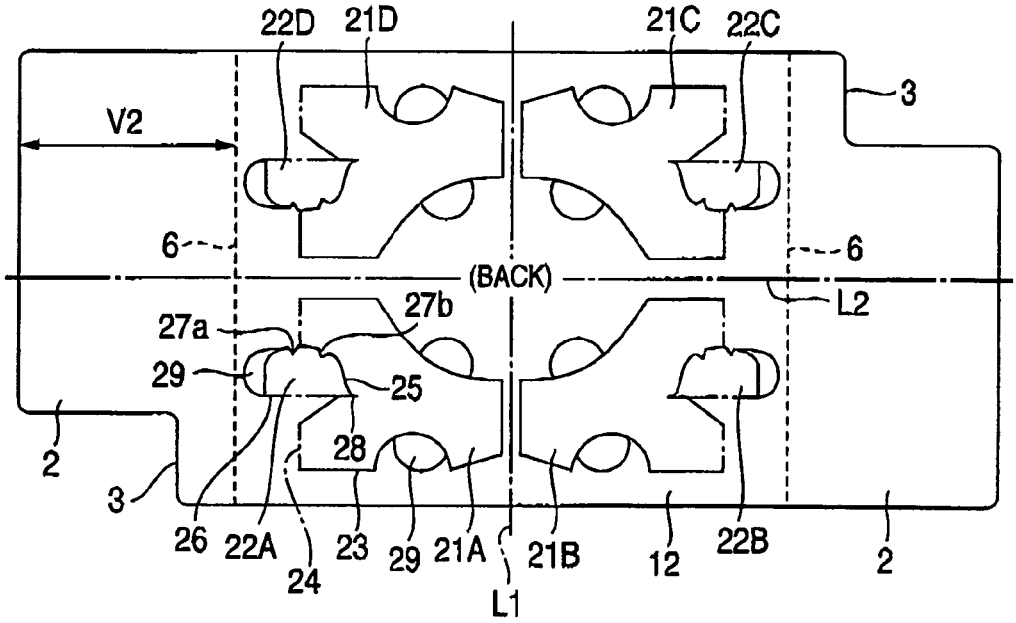
Figure 2:
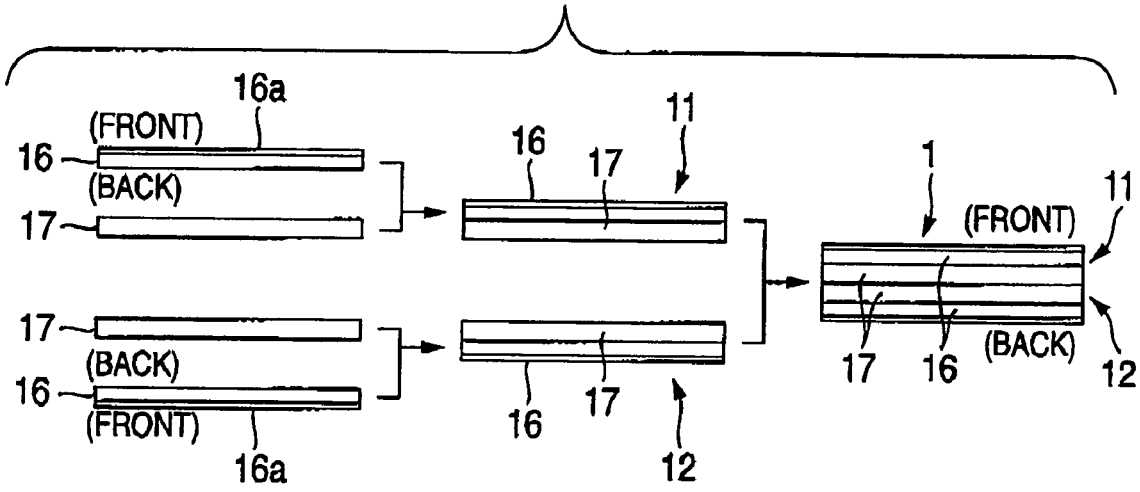
FIG. 2 is a schematic view showing a layered structure of a base member of the image recording medium.
Figure 3:
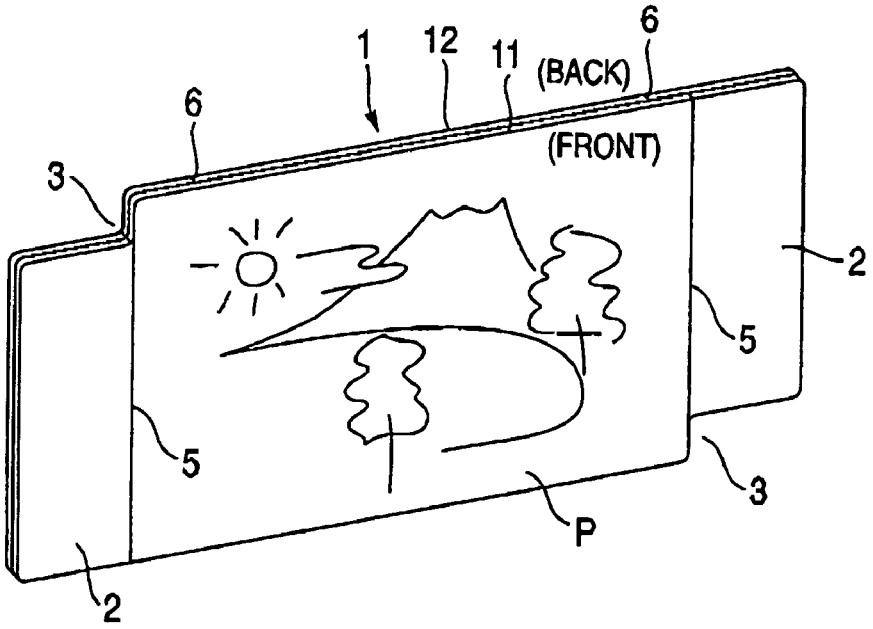
FIG. 3 is a perspective view showing an outer appearance of the image recording medium as seen from the front side.
Figure 4:
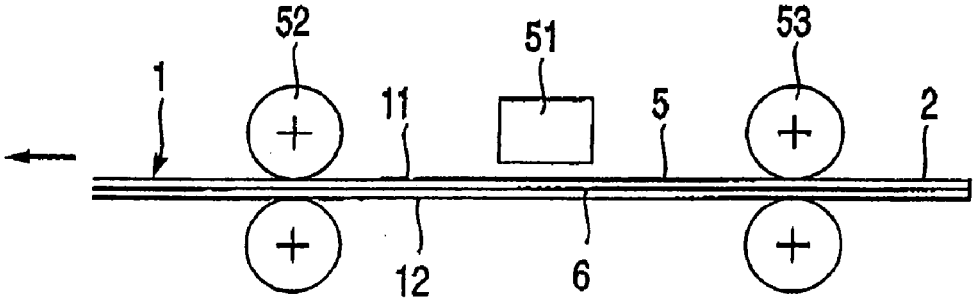
FIG. 4 is a side view schematically showing a manner of printing on the image recording medium.
Figure 5A:
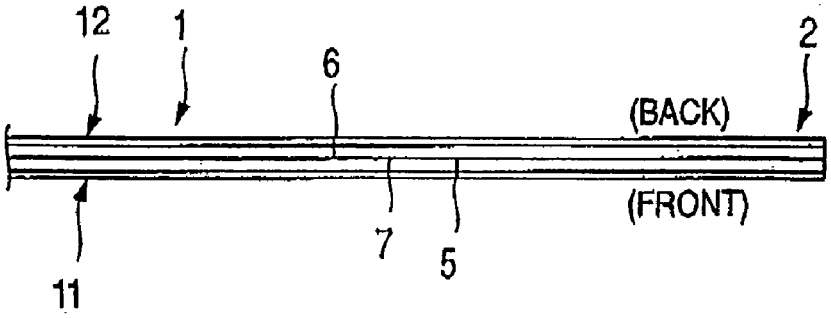
Figure 5B:
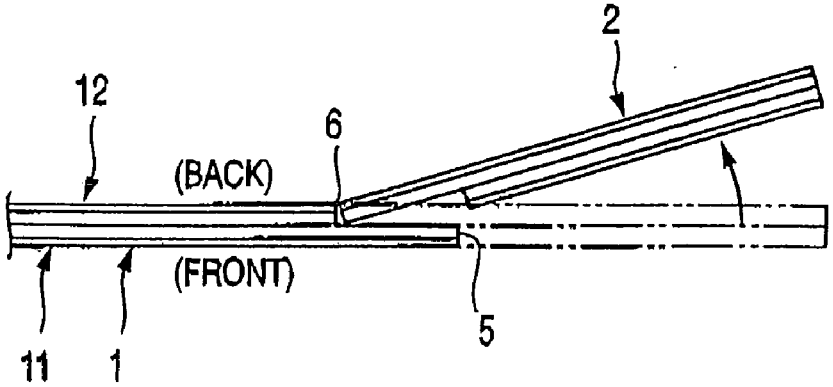
Figure 6:
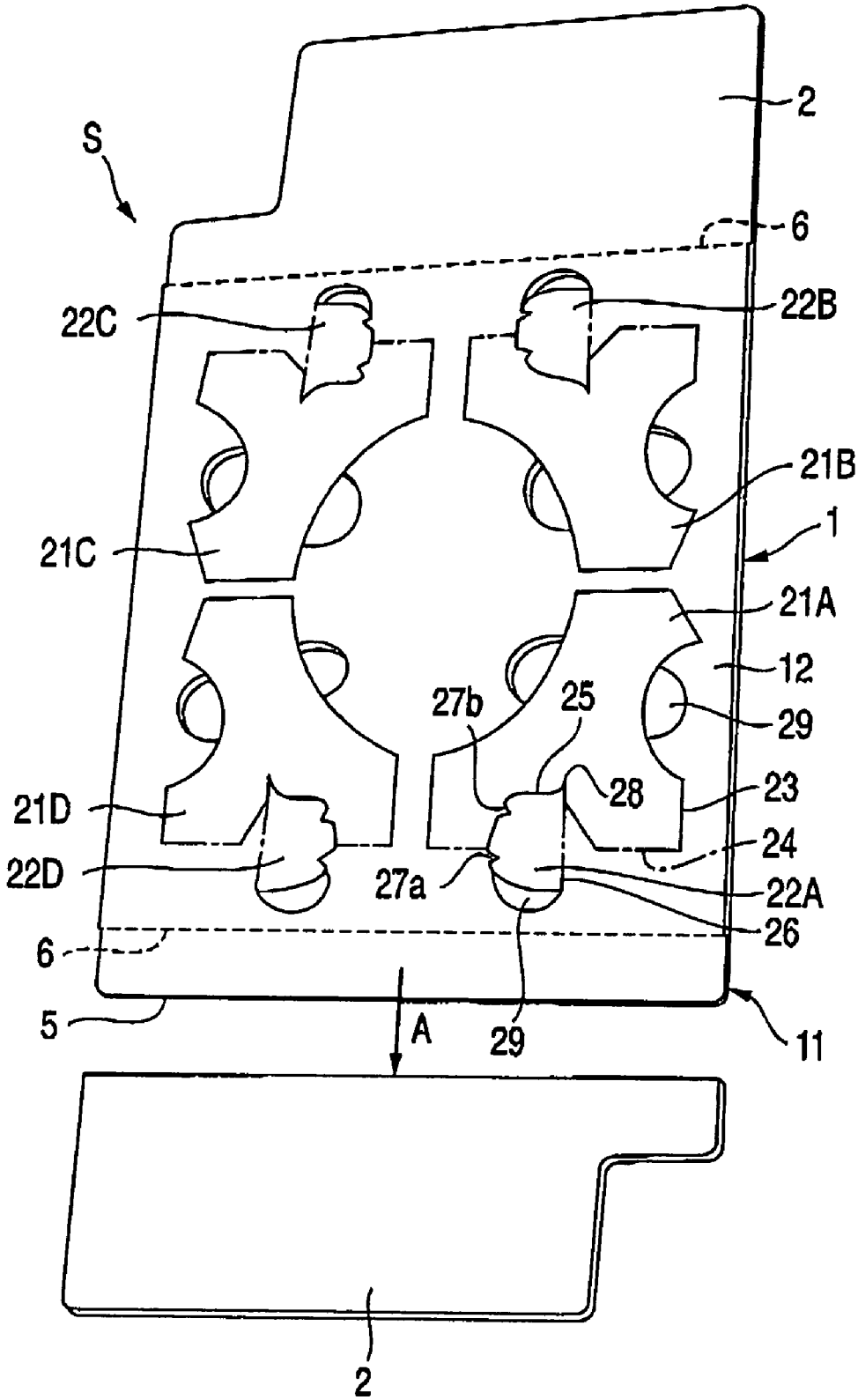
FIG. 6 is a perspective view of the image recording medium in a state where one of the auxiliary portions has been detached, as seen from the back side, for explaining assembling steps in case where the image recording medium is used as a photo stand.
Figure 7:
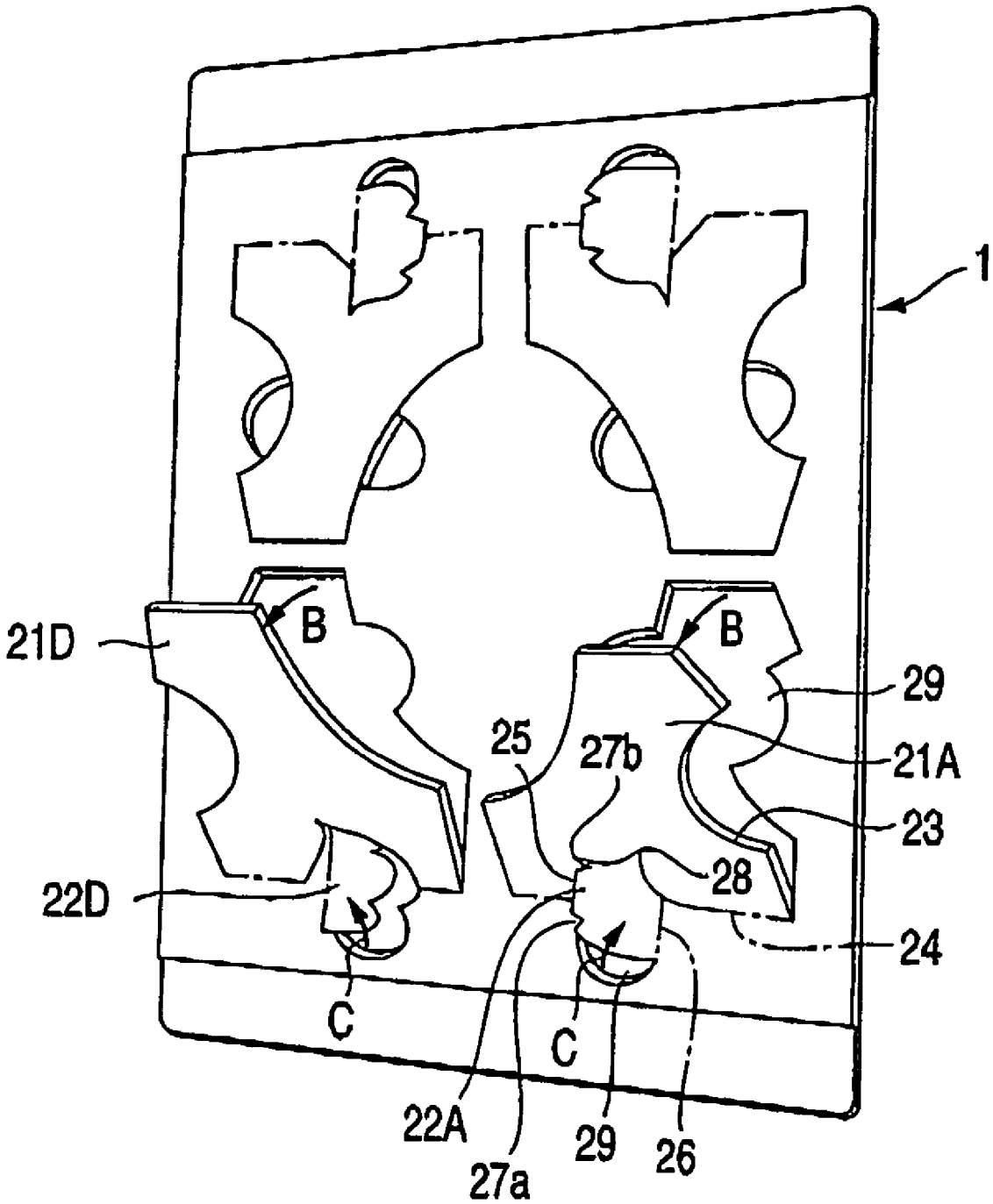
FIG. 7 is a perspective view showing the image recording medium while leg portions and leg supporting portions which are holding members for the base member are pulled up.
Figure 8:
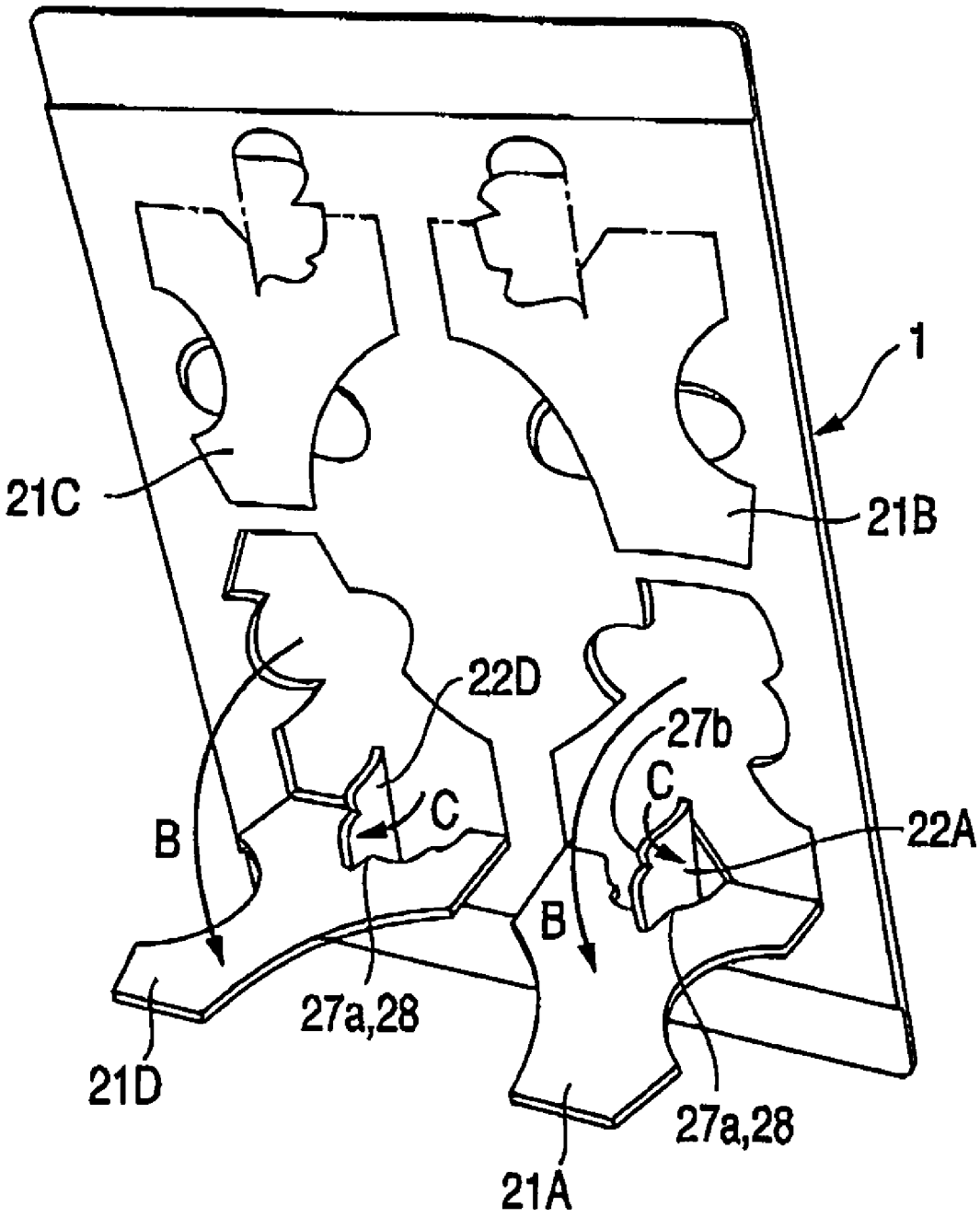
FIG. 8 is a perspective view as seen from the back side when the base member has been vertically installed.
Figure 9:
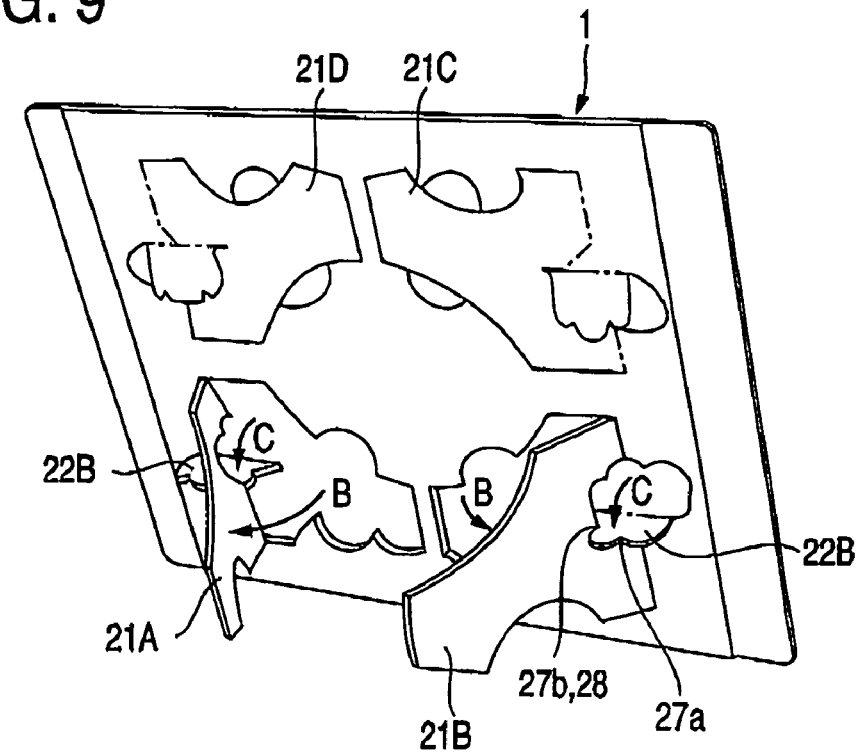
FIG. 9 is a perspective view as seen from the back side when the base member has been laterally installed.

FIGS. 1A to 1C show a general structure of the image recording medium in the embodiment according to the invention, in which FIG. 1A is a plan view as seen from a front side, FIG. 1B is a side view, and FIG. 1C is a plan view as seen from a back side. FIG. 2 is a schematic view showing a layered structure of a base member of the image recording medium. FIG. 3 is a perspective view showing an outer appearance of the image recording medium as seen from the front side. FIG. 4 is a side view schematically showing a manner of printing on the image recording medium. FIGS. 5A and 5B show a manner of detaching an auxiliary portion of the image recording medium, in which FIG. 5A is a side view showing the auxiliary portion in a flat state before it is detached, and FIG. 5B is a side view showing on a way of detaching. FIGS. 6 to 9 are views for explaining assembling steps in case where the image recording medium is used as the photo stand, in which FIG. 6 is a perspective view of the image recording medium in a state where one of the auxiliary portions has been detached, as seen from the back side, FIG. 7 is a perspective view showing the image recording medium while leg portions and leg supporting portions which are holding members for the base member are pulled up. FIG. 8 is a perspective view as seen from the back side when the base member has been vertically installed. FIG. 9 is a perspective view as seen from the back side when the base member has been laterally installed.

As shown by the general structure in FIGS. 1 to 6, an image recording medium S according to the present invention includes a base member 1 in a rectangular shape having an image recording face P, on its front face, on which an image can be recorded by an image recording apparatus, auxiliary portions (flaps) 2 in a rectangular shape attached to both ends of the base member 1 in a longitudinal direction thereof as protruding pieces which are flush with the image recording face P and can be detached from the base member 1, and four sets of leg portions 21A to 21D and leg supporting portions 22A to 22D which are provided on the back face of the base member 1, as holding members for holding the base member 1, when the base member 1 is made upright at a predetermined angle with respect to an installation face such as a table.

The four sets of the leg portions 21A to 21D and the leg supporting portions 22A to 22D are provided corresponding to four edges of the base member 1 in a rectangular shape. A first set of the leg portion 21A and the leg supporting portion 22A and a second set of the leg portion 21B and the leg supporting portion 22B are juxtaposed along one of longer edges (a lower edge in FIG. 1C) of the base member 1, in symmetry with each other with respect to a center line L1 in the longitudinal direction of the base member 1. On the other hand, a third set of the leg portion 21C and the leg supporting portion 22C and a fourth set of the leg portion 21D and the leg supporting portion 22D are juxtaposed along the other longer edge (an upper edge in FIG. 1C) of the base member 1, in symmetry with each other with respect to the center line L1 in the longitudinal direction of the base member 1. Moreover, the first set of the leg portion 21A and the leg supporting portion 22A and the fourth set of the leg portion 21D and the leg supporting portion 22D are juxtaposed along one of shorter edges (a left edge in FIG. 1C) of the base member 1, in symmetry with each other with respect to a center line L2 in a lateral direction of the base member 1. On the other hand, the second set of the leg portion 21B and the leg supporting portion 22B and the third set of the leg portion 21C and the leg supporting portion 22C are juxtaposed along the other shorter edge (a right edge in FIG. 1C) of the base member 1, in symmetry with each other with respect to the center line L2 in the lateral direction of the base member 1.

The leg portions 21A to 21D are provided integrally with the base member I through connecting portions (folding lines) 24, and exert a function of holding the base member 1 at a predetermined angle with respect to an installation face, by bending the connecting portions 24. The leg supporting portions 22A to 22D are provided integrally with the base member 1 through connecting portions (folding lines) 26, and exert a function of positioning the leg portions 21A to 21D at a predetermined angle with respect to the base member 1, by bending the connecting portions 26.

The leg supporting portions 22A to 22D are respectively provided with first notched grooves 27*a* which can be engaged with engaging grooves 28 respectively provided in the leg portions 21A to 21D, thereby to hold the base member 1 at a first position through the leg portions 21A to 21D, and second notched grooves 27*b* which can be engaged with the engaging grooves 28 respectively provided in the leg portions 21A to 21D, thereby to hold the base member 1 at a second position through the leg portions 21A to 21D. In this case, the first position is a position where the base member 1 is stably held, when the base member 1 is vertically installed on the table or the like, and the second position is a position where the base member 1 is stably held, when the base member 1 is laterally installed on the table or the like.

Then, referring to FIG. 2, a layered structure of the image recording medium will be described. The auxiliary portion 2 also has a layered structure, and so, the description will be made referring to only the layered structure of the base member 1 as a representative.

The base member 1 has a structure including a first base portion 11 on a front side and a second base portion 12 on a back side, which are symmetrically faced with each other and adhesively superposed. Both the first base portion 11 and the second base portion 12 have exactly the same structure each including two layers. The two layers are composed of an image recording layer 16 on an upper side and a supporting layer 17 on a lower side for supporting the image recording layer. The image recording layer 16 is formed of inkjet recording paper having an ink reception layer 16*a* superposed on a substrate for example, while the supporting layer 17 is formed of cardboard. The base member 1 has the structure including the four layers superposed, as described above, in which a first layer of the image recording layer 16, a second layer of the first supporting layer 17, a third layer of the second supporting layer 17, and a fourth layer of the image recording layer 16 are stacked, in this order, from the front side to the back side.

The reason why the first base portion 11 and the second base portion 12 each having the two layers of the same structure are adhered face to face symmetrically is to prevent the base member 1 from curling due to a change in temperature or so. Particularly, the image recording layer 16 of the second base portion 12 (the back side) will exert a function as a curl preventing layer, by taking balance between the front face and the back face.

The above described ink reception layer 16*a* contains at least inorganic particles on the substrate. As the substrate, a plastic film of polyethylene, polypropylene, polyethylene terephthalate (PET), etc., and a sheet member formed of paper material such as high quality paper, coated paper, and laminated paper, etc. are employed.

As the above mentioned inorganic particles, for example, porous non-crystalloid silica, porous non-crystalloid alumina, porous noncrystalloid magnesium carbonate, etc. are preferably employed. An amount of the inorganic particles to be contained is preferably 30 to 90 weight % with respect to dry weight of the ink reception layer 16*a*.

The ink reception layer 16*a* contains, as a binder of the inorganic particles, water soluble macro-molecule or emulsion such as polyvinyl alcohol, vinyl acetate, acryl, etc. An amount of the binder to be contained is preferably 5 to 60 weight parts with respect to 100 weight parts of the above described porous inorganic particles. In addition, the ink reception layer 16*a* may contain, according to necessity, one or more additives selected from a group consisting of dye fixer, fluorescent brighter, fungicide, antiseptic, surfactant, viscosity improver, pH regulator, antifoaming agent, hardening agent, leveling agent, ultraviolet absorbing agent, etc.

Formation of the ink reception layer 16*a* can be conducted by applying a coating solution containing the inorganic particles, the binder and so on, onto the substrate by various coating methods, such as roll coating method, rod bar coating method, air knife coating method, etc. On this occasion, a thickness of the ink reception layer 16*a* is preferably 10 to 60 μm from a viewpoint of ink absorbance, anti-flouring, etc. Moreover, touch, taste and so on of the ink reception layer 16*a* are not particularly restricted, but the ink reception layer 16 may present matt finished taste, high glossy taste such as a mirror finished face by cast coating method, or half glossy taste.

The above described four sets of the leg portions 21A to 21D and the leg supporting portions 22A to 22D are provided on the second base portion 12, and cutting lines 23, 25 having predetermined outlines are formed in a part of the second base portion 12, so that the leg portions 21A to 21D and the leg supporting portions 22A to 22D can be pulled up by bending the connecting portions 24, 26. A cutting depth of the cutting lines 23, 25 is extended to all the layers of the second base portion 12 but does not reach the first base portion 11.

In addition, the second base portion 12 is provided with openings 29 respectively at positions adjacent to the leg portions 21A to 21D and the leg supporting portions 22A to 22D. These openings 29 are provided for the purpose of inserting a finger or the like therein to make a pulling work easy, when the leg portions 21A to 21D and the leg supporting portions 22A to 22D are pulled up.

Then, relation between the auxiliary portions 2 and the base member 1 will be described.

The auxiliary portions 2 are continuously provided on the shorter edged areas of the base member 1 at both ends in the longitudinal direction, in a manner of protruding by the smallest length as required. As shown in FIG. 4, these auxiliary portions 2 are provided mainly for the purpose of extending the length of the image recording medium S, when an image is recorded on the base member 1 by a printing head 51 of the image recording apparatus. Specifically, although the image recording medium S must be stably supported by rollers 52, 53 while printing, the support of the image recording medium S is likely to become unstable in case where the printing is made up to extreme ends of the base member 1, if the image recording medium S terminates at the extreme ends. For this reason, the auxiliary portions 2 are provided as extensions of the image recording medium S thereby to stabilize the support. By providing the auxiliary portions in this manner, the image can be recorded up to the extreme ends of the base member 1 (so-called frameless printing). Moreover, because the auxiliary portions 2 are not the parts where the image is to be recorded thereon, it is possible to protect the image recording face of the base member 1 so as not to be soiled, by gripping these auxiliary portions 2 to handle the image recording medium S.

Each of these auxiliary portions 2 has the same layered structure as the base member 1, and the surface of the auxiliary portion 2 Is continued to the image recording face P of the base member 1 in flush therewith, so that the auxiliary portion 2 may not interfere with the printing head or so. Moreover, a complete cutting portion 5 of a rectilinear line is formed between the auxiliary portion 2 and the first base portion 11 on the front side, for enabling the auxiliary portion 2 to be easily detached, and a noncontiguous cutting portion 6 of a perforated rectilinear line is formed between the auxiliary portion 2 and the second base portion 12 on the back side. A non cut portion of the noncontiguous cutting portion 6 on the back side keeps the auxiliary portion 2 in a state joined to the base member 1. In this case, a length V1 from an end edge of the auxiliary portion 2 in the longitudinal direction to the complete cutting portion 5 is set to be smaller than a length V2 from the end edge of the auxiliary portion 2 in the longitudinal direction to the noncontiguous cutting portion 6 on the back side. As shown in FIG. 5B, the auxiliary portion 2 is adhered to the second base portion 12 with a detachable amount of an adhesive, in an area 7 between the complete cutting portion 5 and the noncontiguous cutting portion 6 which are deviated in position.

Further, the auxiliary portion 2 is formed with a cut-out 3 in an end part thereof in the lateral direction (the same lateral direction of the base member 1), eliminating the auxiliary portion 2 in this part. This cut-out 3 is formed mainly for the purpose of avoiding an interference of a detecting piece with the complete cutting portion 5 or the noncontiguous cutting portion 6, in case where the image recording is conducted by a printer provided with a paper detecting device of mechanical type which detects the paper by tracing along the upper face or the lower face of the image recording medium with the detecting piece.

One end in the longitudinal direction of the complete cutting portion 5 (an end intersecting the longer edge of the base member 1) of a rectilinear line is curved in a small arc so that a corner of the base member 1 may be rounded, when the auxiliary portion 2 has been detached. On the other hand, both ends in the longitudinal direction of the noncontiguous cutting portion 6 terminate in a rectilinear cut, because the noncontiguous cutting portion 6 is in a position to be hidden from the front side, as described below.

Then, a manner of using the image recording medium having the above described structure, and its operation will be described.

In case of printing an image on this image recording medium S, the image will be recorded on the image recording face P on the front face side, as shown in FIG. 3. Then, as shown by an arrow mark A in FIG. 6, the auxiliary portions 2 on the both ends which are no more required will be detached. On this occasion, because the complete cutting portions 5 in the first base portion 11 on the front face have been almost cut in advance, as shown in FIG. 5, only the noncontiguous cutting portions 6 in the second base portion 12 on the back face will be torn off to detach the auxiliary portions 2.

When the auxiliary portions 2 have been detached by cutting at the noncontiguous cutting portions 6 in this manner, cutting faces may be undulated. However, the noncontiguous cutting portions 6 on the back face (in the second base portion 12) are positioned more close to a center in the longitudinal direction of the base member 1 than the complete cutting portions 5 on the front face (in the first base portion 11), the aforesaid undulation will be hidden behind the first base portion 11 after the auxiliary portions 2 have been detached. On this occasion, the end edges of the first base portion 11 which have been cut at the complete cutting portions 5 will present clear cutting lines by mechanical cutting, and therefore, only the clear cutting lines can be seen from the front, on the end edges of the base member 1 after the auxiliary portions 2 have been detached. As the result, those parts having an unfavorable appearance will be hidden from the front side, and the appearance as seen from the front will not be damaged.

Then, according to a direction of the image, a direction in which the image recording medium is to be placed on the installation face such as the table will be determined. Selecting two sets of the leg portions 21A and 21D and the leg supporting portions 22A and 22D positioned along the lower edge out of the four edges of the base member 1, the relevant two sets of the leg portions 21A and 21D and the leg supporting portions 22A and 22D will be respectively pulled up in directions of arrow marks B and C, by bending the connecting portions 24, 26. FIG. 7 shows an example in which the base member 1 is vertically installed, and the two sets of the leg portions 21A and 21D and the leg supporting portions 22A and 22D along one of the shorter edges are pulled up. Because the openings 29 are formed adjacent to the leg portions 21A and 21D and the leg supporting portions 22A and 22D, they can be easily pulled up.

After the leg portions 21A and 21D and the leg supporting portions 22A and 22D have been pulled up to some extent, the engaging grooves 28 of the leg portions 21A and 21D are engaged with either of the notched grooves 27*a*, 27*b* of the leg supporting portions 22A and 22D, as shown in FIG. 8. In this case, because the first notched grooves 27*a* are provided for vertical installation, and the second notched grooves 27*b* are provided for lateral installation, the engaging grooves 28 of the leg portions 21A and 21D are engaged with the first notched grooves 27*a* for the vertical installation. In this manner, the engaged parts can be stabilized, and angles of the leg portions 21A, 21D can be fixed. As the results, it is possible to hold the base member 1 stably at the predetermined angle in a vertically installed state, with one of the shorter edges of the base member 1 placed on the installation face, by the leg portions 21A, 21D extended on the back face.

In case of vertically installing the base member 1 in an opposite direction, the two sets of the leg portions 21B and 21C and the leg supporting portions 22B and 22C will be selected and assembled in the same manner, and then, the base member 1 will be placed on the installation face. On the other hand, in case of laterally installing the base member 1, the two sets of the leg portions 21A and 21B and the leg supporting portions 22A and 22B or the two sets of the leg portions 21C and 22D and the leg supporting portion 22C and 22D will be selected according to the direction to be installed, and assembled in the same manner, as shown in FIG. 9, and then, the base member 1 will be placed on the installation face. It is to be noted that in case of the lateral installation, the angle of the base member 1 can be determined by engaging the engaging grooves 28 of the leg portions 21A to 21D with the second notched grooves 27*b* of the leg supporting portions 22A to 22D.

As described above, after the image has been recorded on the image recording face P of the base member 1, the base member 1 can be immediately installed on the installation face such as the table, by employing the leg portions 21A to 21D and the leg supporting portions 22A to 22D, and thus, the image recording medium S can be used as a photo stand as it is. Therefore, a trouble of separately preparing the photo stand will be eliminated, and it is possible to easily display printed matters such as a photograph on the table.

Moreover, by appropriately selecting and assembling the sets of the leg portions 21A to 21D and the leg supporting portions 22A to 22D, the bass member 1 can be installed in four directions, and the leg portions 21A to 21D can be positioned at the predetermined angle by the leg supporting portions 22A to 22D. As the results, the base member 1 can be stably held at a certain angle by anyone who wants to assemble it.

Further, in this image recording medium S, the base member 1 includes the first base portion 11 having the image recording face P, and the second base portion 12 adhered thereto, and the leg portions 21A to 21D and the leg supporting portions 22A to 22D are provided on the second base portion 12. Accordingly, such works as forming the cutting portions (the cutting lines) for the purpose of providing the leg portions 21A to 21D and the leg supporting portions 22A to 22D can be conducted without influencing the first base portion 11, and production will be made easier. In addition, because the base member 1 is composed of the two layers adhered to each other, the works of providing the leg portions 21A to 21D and the leg supporting portions 22A to 22D on the back face, and the works of displacing the positions of the cutting portions 5, 6 on boundaries between the base member 1 and the auxiliary portions 2, between the front face and the back face, can be easily conducted.

Now, the best form of the image recording medium S having the above described structure when it is stored, transported, or sold will be described.

Although both the front and back faces of this image recording medium S are formed flat, the leg portions 21A to 21D and the leg supporting portions 22A to 22D are provided on the back face so as to be pulled up, as described above. Besides, the image recording medium S is made rather thicker than ordinary printing paper, and every sheet of the image recording medium S has a considerable weight. Therefore, in case where a plurality of the image recording media S have been stacked with their image recording faces (surfaces) directed in the same direction as the ordinary printing paper, the areas provided with the leg portions 21A to 21D and the leg supporting portions 22A to 22D may strike the image recording faces P, and the image recording faces P may be damaged or soiled, occurring such an anxiety that quality of the recorded image may be deteriorated. In order to avoid such anxiety, it is considered to interpose a protective sheet between the adjacent image recording media S, which, however, will result in an increase in number of the protective sheets and will lead to a rise of cost.

Figure 10:
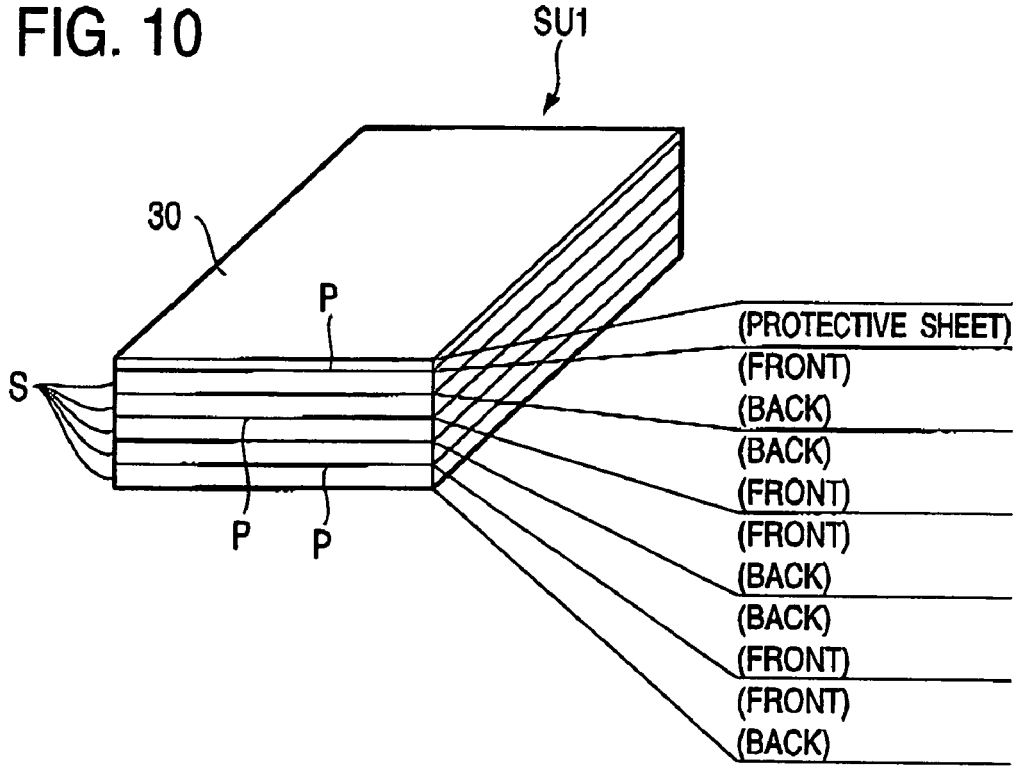
FIG. 10 is a perspective view showing an example in which a plurality of the image recording media are stacked in a set.
Figure 11:
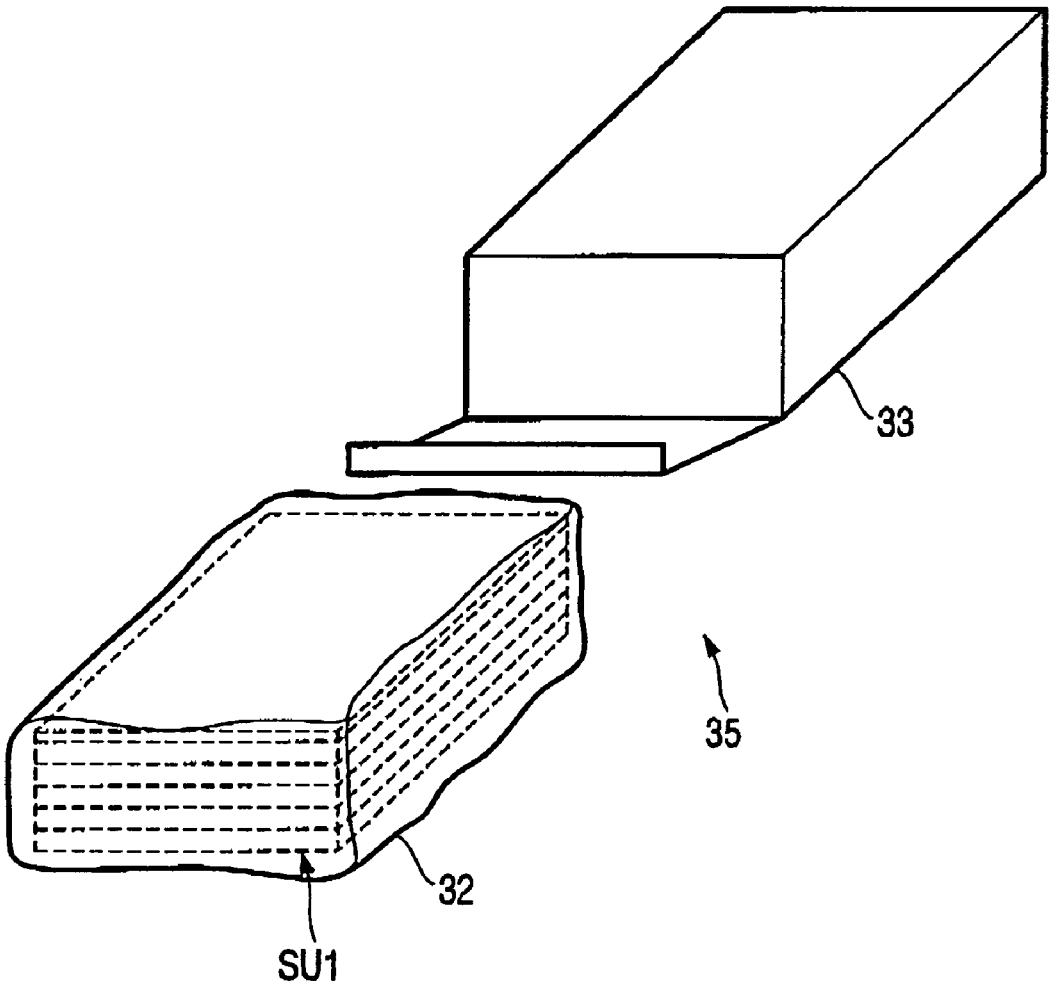
FIG. 11 is an explanatory view showing a package containing a set of a plurality of the image recording media.

Under the circumstances, it is proposed that when a plurality of the image recording media S are put on sale in a set, the image recording medium S in the lowermost layer is arranged with its back face directed downwardly and its front face directed upwardly, as shown in FIG. 10, and a plurality of the image recording media S are stacked thereon, one on another, in such a manner that the front face is faced with the next front face, and the back face is faced with the next back face in order. In case where the image recording medium S in the uppermost layer is directed upwardly, in other words, in case where an odd number of the image recording media S are stacked, the surface of the image recording medium S in the uppermost layer will be covered with a protective sheet 30 thereby to constitute a set SU1 including a plurality of the image recording media. Then, as shown in FIG. 11, this set SU1 will be contained in a damp-proof transparent bag 32 capable of maintaining the image recording media S in the stacked state, and packed in a box 33, thereby to form a packaged article 35 of the image recording media. By packing the image recording media S in this manner, it is possible to protect the image recording faces P, and to guarantee the high grade recording.

Figure 12:
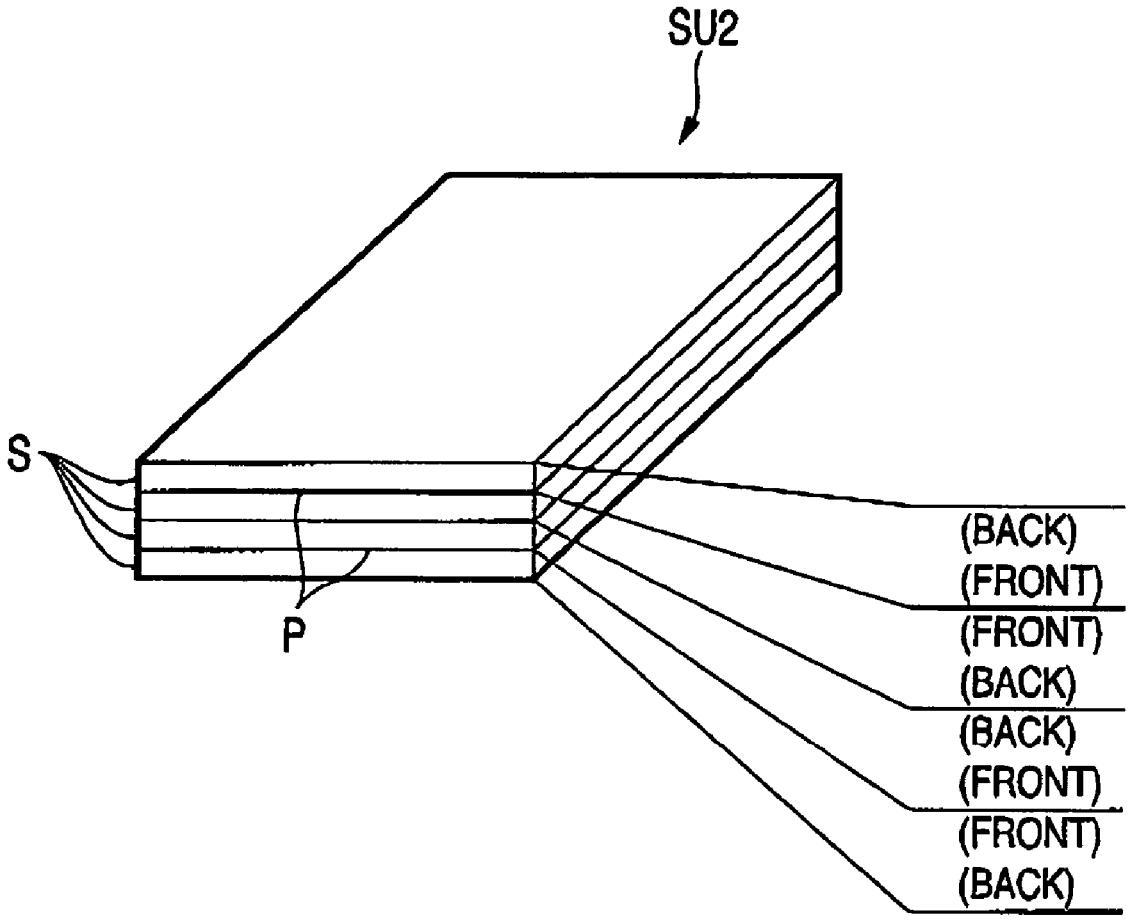
FIG. 12 is a perspective view showing an example in which an even number of the image recording media are stacked in a set.

In case where an even number of the image recording media S are stacked to form a set SU2 as shown in FIG. 12, the back face of the image recording medium S in the uppermost layer is directed upwardly, and need not be covered with the protective sheet.

Then, referring to FIG. 13, a modification of the image recording medium 8 according to the invention will be described.

Figure 13A:
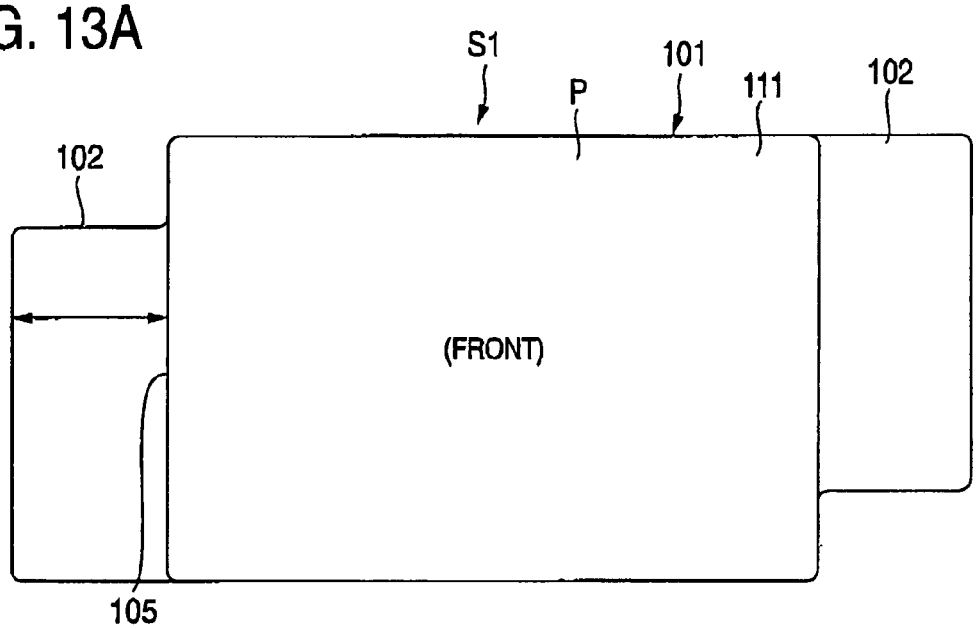
Figure 13B:
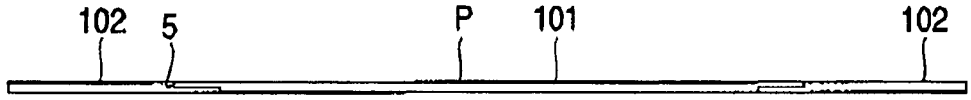
Figure 13C:
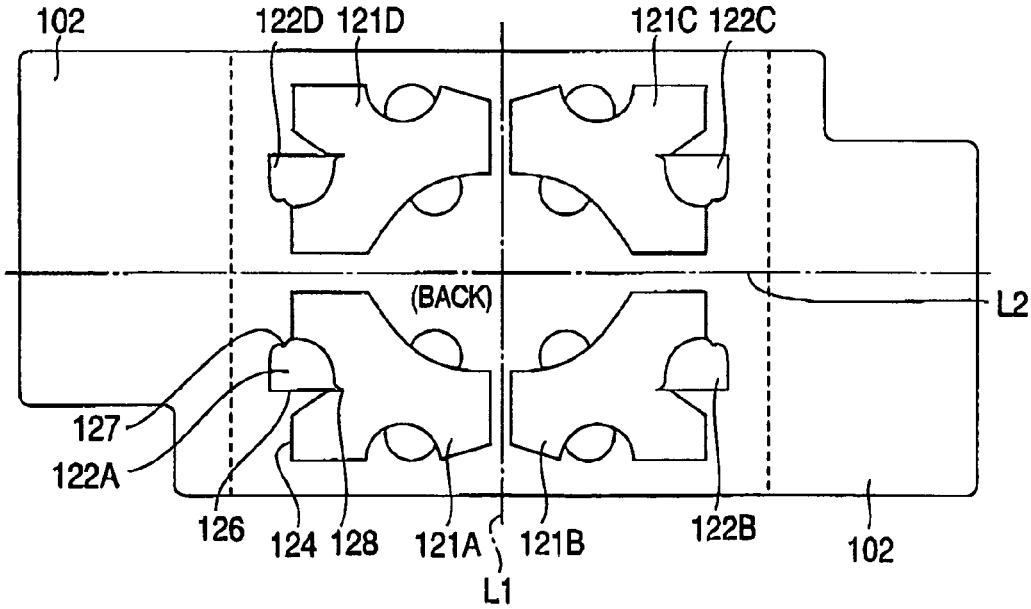

FIGS. 13A to 13C show a general structure of the image recording medium in the modification, in which FIG. 13A is a plan view as seen from the front side, FIG. 13B is a side view, and FIG. 13C is a plan view as seen from the back side.

As shown in FIG. 13, this image recording medium S1 includes a base member 101 in a rectangular shape having an image recording face P, on its front face, on which an image can be recorded by an image recording apparatus, auxiliary portions (flaps) 102 in a rectangular shape attached to both ends of the base member 101 in a longitudinal direction thereof as protruding pieces which are flush with the image recording face P and detachable from the base member 101, and four sets of leg portions 121A to 121D and leg supporting portions 122A to 122D which are provided on the back face of the base member 101, as holding members for holding the base member 101, when the base member 101 is installed at a predetermined angle with respect to an installation face such as a table.

The four sets of the leg portions 121A to 121D and the leg supporting portions 122A to 122D are provided corresponding to four edges of the base member 101 in a rectangular shape. A first set of the leg portion 121A and the leg supporting portion 122A and a second set of the leg portion 121B and the leg supporting portion 122B are juxtaposed along one of longer edges (a lower edge in *Fig.* 13C) of the base member 101, in symmetry with each other with respect to a center line L1 in a longitudinal direction of the base member 101. On the other hand, a third set of the leg portion 121C and the leg supporting portion 122C and a fourth set of the leg portion 121D and the leg supporting portion 122D are juxtaposed along the other longer edge (an upper edge in FIG. 13C) of the base member 101, in symmetry with each other with respect to the center line L1 in the longitudinal direction of the base member 101. Moreover, the first set of the leg portion 121 A and leg supporting portion 122A and the fourth set of the leg portion 121D and the leg supporting portion 122D are juxtaposed along one of shorter edges (a left edge in FIG. 13C) of the base member 101, in symmetry with each other with respect to a center line L2 in a lateral direction of the base member 101. On the other hand, the second set of the leg portion 121B and the leg supporting portion 122B and the third set of the leg portion 121C and the leg supporting portion 122C are juxtaposed along the other shorter edge (a right edge in FIG. 13C) of the base member 101, in symmetry with each other with respect to the center line L2 in the lateral direction of the base member 101.

The leg portions 121A to 121D are provided Integrally with the base member 101 through connecting portions (folding lines) 124, and will exert a function of holding the base member 101 at a predetermined angle with respect to the installation face, by bending the connecting portions 124. The leg supporting portions 122A to 122D are provided integrally with the base member 101 through connecting portions (folding lines) 126, and will exert a function of positioning the leg portions 121A to 121D at a predetermined angle with respect to the base member 101 by bending the connecting portions 126.

The leg supporting portions 122A to 122D are respectively provided with notched grooves 127 which can be engaged with engaging grooves 128 in the leg portions 121A to 121D, thereby to hold the base member 101 at a first position through the leg portions 121A to 121D.

Other features such as the layer structure and functions of the image recording medium S1 are substantially the same as in the image recording medium S in the foregoing embodiment.

In this modification, in case where an image has been recorded on the image recording face P of the image recording medium S1, and the base member 1 of the image recording medium S1 is vertically installed, the auxiliary portions 102, 102 will be tom off. Then, the leg portions 121A and 121D and the leg supporting portions 122A and 122D will be pulled up to some extent, and the engaging grooves 128, 128 of the leg portions 121A, 121D are engaged with the notched grooves 127, 127 of the leg supporting portions 122A, 122D. In this manner, the engaged parts can be stabilized, and angles of the leg portions 121A, 121D can be fixed. As the results, it is possible to hold the base member 101 stably at the predetermined angle in a vertically installed state, with one of the shorter edges placed on the installation face, by the leg portions 121A, 121D extended on the back face.

On the other hand, in case where an image has been recorded on the image recording face P of the image recording medium S1, and the base member 101 of the image recording medium S1 is laterally installed, the auxiliary portions 102, 102 will be torn off. Then, the leg portions 121A and 121B and the leg supporting portions 122A and 122B will be pulled up to some extent, and the engaging grooves 128, 128 of the leg portions 121A, 121B are engaged with the notched grooves 127, 127 of the leg supporting portions 122A, 122B. In this manner, the engaged parts can be stabilized, and angles of the leg portions 121A, 121B can be fixed. As the results, it is possible to hold the base member 101 stably at the predetermined angle in a laterally installed state, with one of the longer edges placed on the installation face, by the leg portions 121A, 121B extended on the back face.

As described above referring to the image recording medium S1 in this modification, even though the leg supporting portions 122A to 122D are respectively provided with only one notched grooves 127, substantially the same operation and effects as the image recording medium S in the foregoing embodiment can be attained.

What is claimed is:

1. An image recording medium or display on a surface, the image recording medium comprising:

a base member, having an image recording face for recording an image thereon; and a holding member, being operable to hold the base member at a predetermined degree with respect to the surface, wherein the base member has: a first base portion having the image recording face; and a second base portion superposed on the first base portion; wherein the second base portion is provided with the holding member, and wherein the first base portion has:

an image recording layer, having the image recording face; and a first supporting layer, supporting the image recording layer; and wherein the second base portion has:

a second supporting layer, formed on the first supporting layer; and a curl preventing layer, formed on the second supporting layer for preventing a curl of the base member.

2. The image recording medium as set forth in claim 1, wherein the base member is provided with the holding member through a connecting portion; and wherein the base member is held at the predetermined degree with respect to the installation face by bending the connecting portion.

3. The image recording medium as set forth in claim 1, wherein the holding member is a plurality of the holding members.

4. The image recording medium as set forth in claim 1, wherein the holding member is formed by cutting a part of the second base portion.

5. The image recording medium as set forth in claim 1, wherein the second base portion has an opening adjacent to the holding member.

6. The image recording medium as set forth in claim 1, wherein an auxiliary portion is detachably provided at least one end of the base member in a longitudinal direction thereof; and wherein the auxiliary portion is flush with the image recording face.

7. An image recording medium for display on a surface, the image recording medium comprising:

a base member, having an image recording face for recording an image thereon; and a holding member, being operable to hold the base member at a predetermined degree with respect to the surface, wherein the base member has: a first base portion having the image recording face; and a second base portion superposed on the first base portion;

wherein the second base portion is provided with the holding member, wherein an auxiliary portion is detachably provided at least one end portion of the base member in a longitudinal direction thereof;

wherein the auxiliary portion is flush with the image recording face; wherein a completely cutting portion is formed between the auxiliary portion and the first base portion, the completely cutting portion extending in a minor axis direction of the base member;

wherein a noncontiguous cutting portion is formed between the auxiliary portion and the second base portion, the noncontiguous cutting portion extending in the minor axis direction of the base member; and wherein a first length from an end edge of the auxiliary in the longitudinal direction to the completely cutting portion is smaller than a second length from the end edge of the auxiliary in the longitudinal direction to the noncontiguous cutting portion.

8. The image recording medium as set forth in claim 1, wherein a most front layer of the image recording face is an ink reception layer which has at least a pigment and a binder.

* * * * *